US005785309A

United States Patent [19]

Halup et al.

[11] Patent Number: 5,785,309

[45] Date of Patent: Jul. 28, 1998

[54] AUTOMATIC PLATE FEEDING SYSTEM AND METHOD

[75] Inventors: Nir Halup, Tzoran; Eliyahu Vronsky, Ramat Hasharon, both of Israel

[73] Assignee: Scitex Corporation Ltd., Herzlia, Israel

[21] Appl. No.: 501,839

[22] Filed: Jul. 13, 1995

[30] Foreign Application Priority Data

Jul. 26, 1994 [IL] Israel ..... 110467

[51] Int. Cl.[6] ..... B65H 5/08

[52] U.S. Cl. ..... 271/11; 271/106; 271/107; 271/42; 271/10.14

[58] Field of Search ..... 271/11, 14, 105, 271/106, 137, 107, 10.14–10.16, 101, 42, 104

[56] References Cited

U.S. PATENT DOCUMENTS

| | | | |
|---|---|---|---|
| 3,370,845 | 2/1968 | Newcomb | 271/107 |
| 4,003,567 | 1/1977 | Berger, Jr. et al. | 271/104 X |
| 4,127,262 | 11/1978 | Eberle et al. | 271/106 X |
| 4,958,824 | 9/1990 | Willits et al. | 271/106 X |
| 4,974,825 | 12/1990 | Bizic et al. | 271/14 X |
| 5,367,360 | 11/1994 | McIlwraith et al. . | |

FOREIGN PATENT DOCUMENTS

| | | | |
|---|---|---|---|
| 1197903 | 8/1965 | Germany | 271/14 |
| 36247 | 2/1985 | Japan | 271/10.14 |
| 45032 | 2/1992 | Japan | 271/107 |
| 243736 | 8/1992 | Japan | 271/107 |
| 295273 | 3/1954 | Switzerland | 271/14 |
| 375260 | 12/1930 | United Kingdom | 271/11 |

*Primary Examiner*—Boris Milef
*Attorney, Agent, or Firm*—Mark M. Friedman

[57] ABSTRACT

A plate feeding system for grasping and moving a plate from a stack of plates. The system includes an arm mechanism having a plate grasping member for grasping the plate and a plate interposing member for interposing between the plate and an adjacent plate. Also disclosed is a method of feeding a plate from a stack of plates. The method includes grasping the plate, using a plate grasping member of an arm mechanism, interposing a member between the plate and an adjacent plate, and transporting the plate.

8 Claims, 9 Drawing Sheets

AUTOMATIC PLATE FEEDING SYSTEM AND METHOD

FIELD AND BACKGROUND OF THE INVENTION

The present invention relates to a system and method for automatically loading a plate into an end user machine.

A variety of systems and applications use stacks of sheets of plates, which may be made of aluminum, paper, plastic, and the like, as an input (hereinafter singly or collectively referred to as "plates"). The stacked plates may or may not be separated by a sheet of dividing material, such as a sheet of paper, to prevent scratching or other damage to the active surface of the plates. The plates are typically stacked in a cassette or similar container which houses the plates and facilitates their transportation and handling.

A typical conventional plate feeding system is depicted schematically in FIG. 1.

Plates 10 typically come stacked one on top of the other in a cassette 12 or similar container. One face of each plate 10 typically includes an emulsion which is rather delicate and which could be damaged, as by scratching, through contact with other plates. To avoid such damage, it is sometimes useful to insert a sheet of suitable paper (not shown) between adjacent plates, although in many systems the separating paper is absent, for reasons of cost and operational convenience, and plates 10 lie stacked directly on top of each other.

Various mechanisms have been developed for removing a single plate 10 from cassette 12 and inserting it into the receiving system 14. One commonly available such system consists of a fixed arm mechanism 16 and a movable frame 19, which includes a plate grasping mechanism, such as two or more arrays of suction cups 18, or other mechanisms. Upon demand, movable frame 19, upon which suction cups 18 are mounted, slides relative to fixed arm mechanism 16 toward cassette 12 so that suction cups 18 are correctly located relative to plate 10. Suction cups 18 are then lowered and made to grasp the topmost plate 10. Movable frame 19 then lifts plate 10 and frame 19 is made to slide along fixed arm mechanism 16 to the appropriate location in receiving system 14 where suction cups 18 release plate 10. In those system where plates 10 lie directly on top of each other, the operation is then repeated to remove the next plate 10. In those systems where adjacent plates 10 are separated by a sheet of separating paper, the assembly may first be used to grasp the sheet of paper and move it to a suitable location for disposal.

As can be seen in FIG. 1, the size of arm mechanism 16 is largely determined by the size of plate 10, the arm mechanism 16 and plate 10 being substantially equal in planar extent so as to allow arm mechanism 16 to efficiently grasp, lift and transport plate 10. Thus, to handle a very large plate a substantially equally sized, costly and cumbersome arm mechanism must be used. Furthermore, different sized arm mechanisms must be used when plates of different sizes are to be used, which adds to the cost and complexity of the feeding mechanisms. The size of the conveying system is determined by the largest format of plates which the end user machine is designed to handle.

There is thus a widely recognized need for, and it would be highly advantageous to have, an automatic and compact plate feeding system for efficiently handling the feeding of plates of various sizes.

SUMMARY OF THE INVENTION

According to the present invention there is provided a plate feeding system for grasping and moving a plate from a stack of plates, comprising: (a) an arm mechanism, the arm mechanism including a plate grasping member for grasping the plate; and (b) a plate interposing member for interposing between the plate and an adjacent plate.

Also according to the present invention there is provided a method of feeding a plate from a stack of plates, comprising the steps of: (a) grasping, using a plate grasping member of an arm mechanism, the plate; (b) interposing a plate interposing member between the plate and an adjacent plate; and (c) transporting the plate.

According to further features in preferred embodiments of the invention described below, the plate grasping member is an array of suction cups.

According to still further features in the described preferred embodiments, the plate interposing member includes a plurality of interconnected slats.

The present invention successfully addresses the shortcomings of the presently known configurations by providing a relatively compact system for the automatic feeding of plates of various sizes.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
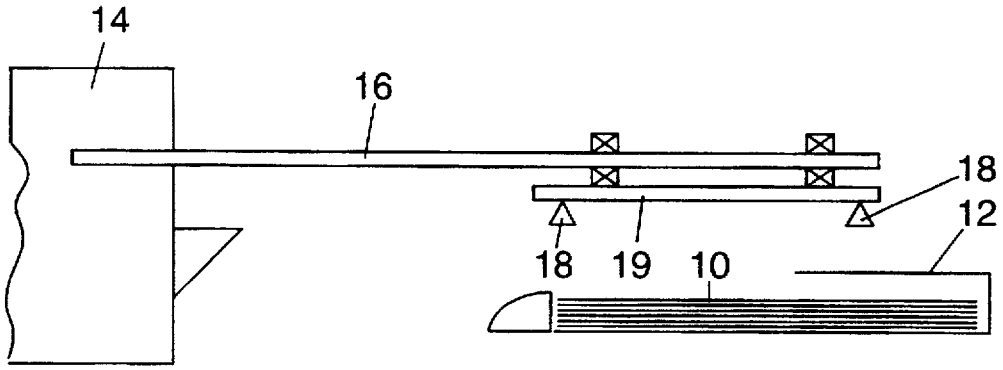
FIG. 1 (PRIOR ART)
FIG. 1 schematically depicts a typical conventional plate loading system.
Figure 2:
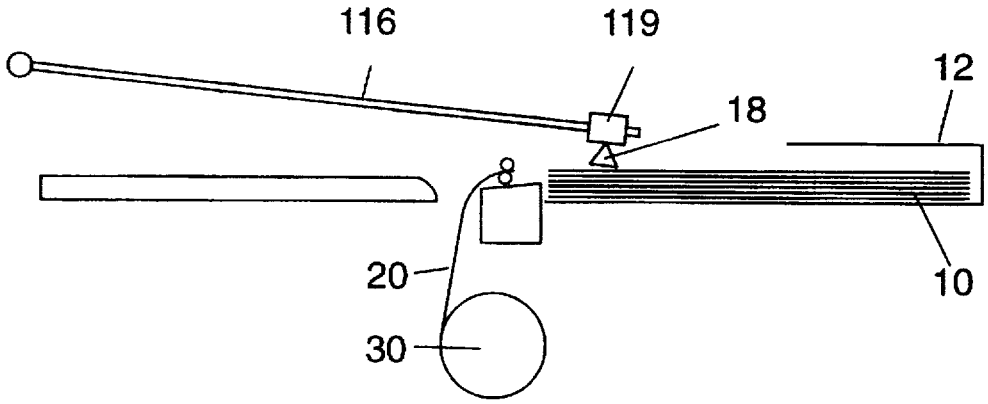
FIGS. 2–5 illustrate the operation of a plate loading system according to the present invention.
Figure 3:
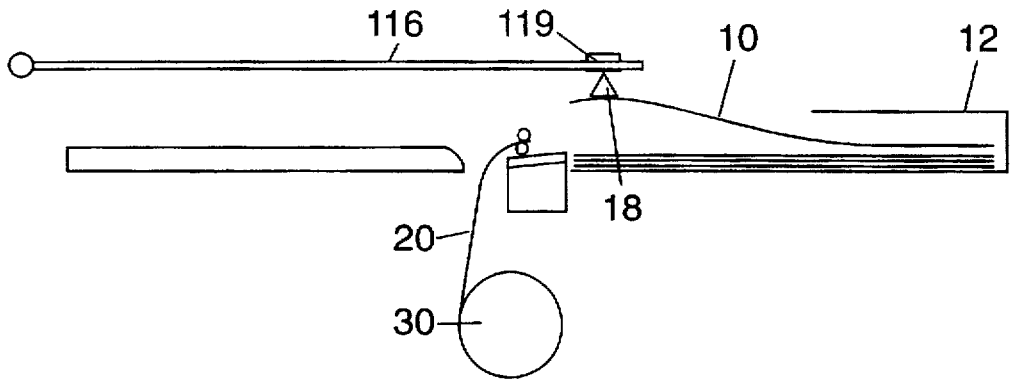
Figure 4:
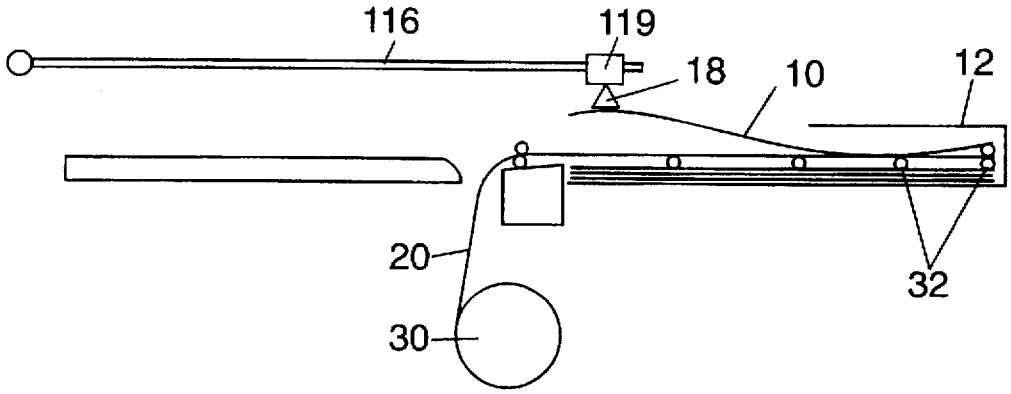

The present invention is of an automatic plate feeding system which can be used to automatically feed plates into an end user device. The principles and operation of a system according to the present invention may be better understood with reference to the drawings and the accompanying description.

Referring now to the drawings, FIGS. 2–5 illustrate the structure and operation of a typical plate feeding system according to the present invention for grasping and moving a plate from a stack plates. Shown in FIGS. 2–5 is a stack of plates 10 located in a cassette 12 where no paper separates adjoining plates 10 and where, instead, plates 10 lie stacked directly one on top of another.

The system includes an arm mechanism 116 which is similar to fixed arm mechanism 16 of FIG. 1 except for two basic differences, one of which is optional.

First, whereas the prior art fixed arm mechanism 16 of FIG. 1 is fixed in a position substantially parallel to plates 10, arm mechanism 116 according to the present invention is optionally able to rotate slightly about a pivot point so that its free end is able to alternately be near (FIG. 2) or far (FIGS. 3–5) from plates 10.

More importantly, arm mechanism 116 includes a plate grasping member, preferably an array of suction cups 18, for grasping plate 10 along substantially a single line transverse to the direction of travel of plate 10, in contrast with a conventional system (FIG. 1) wherein plate 10 is grasped along two (or more) such lines. Preferably, suction cups 18 are mounted directly or indirectly on a slidable unit 119 which is slidable with respect to arm mechanism 116 in such a way that suction cups 18 can be moved from a position toward the anterior end of arm mechanism 116 (see FIGS. 2–4, for example) to a position toward the posterior end of arm mechanism 116 (see FIG. 5, for example). Alternatively, arm mechanism 116 may be fixed with slidable unit 119 able to alternately approach or distance itself from plates 10.

Finally, a system according to the present invention includes a plate interposing member 20 capable of being interposed between the top plate 10 in the stack and the plate immediately below the top plate.

Plate interposing member 20 can be constructed of a wide variety of materials and can have any of a large number of configurations. Preferably, plate interposing member 20 is made up of a plurality of connected slats, typically made of a suitable plastic material. The slats construction makes is possible to readily wind and unwind member 20 onto a roller 30 or in the form of a roll as shown in FIGS. 2–5.

In operation, a device according to the present invention, operating with a stack of plates which are stacked directly one on top of each other, would operate as follows. The grasping element, such as slidable unit 119, featuring a transverse linear array of suction cups 18, would be moved toward the anterior end of arm mechanism 116. At this point suction cups 18, or arm mechanism 116, would be lowered (FIG. 1) to allow suction cups 18 to grasp the top plate 10 along a line substantially close to the near end of plate 10.

Suction cups 18 would then be raised, for example, by raising the end of arm mechanism 116, thereby lifting the near edge of the topmost plate 10. With the near end of the topmost plate 10 lifted, plate interposing member 20 is now interposed between the partially lifted plate and the stack of plates immediately below. The interposition can be effected in a number of ways. Preferably, interposing member 20 is made of a number of connected slats which are wound as a roller or on a roller 30. To deploy interposing member 20, roller 30 is rotated clockwise, using suitable motor or other mechanism (not shown), so as to slide between the top plate and the stack plate (FIG. 4), in the process lifting and separating the top plate from the rest of the stack of plates.

Figure 5:
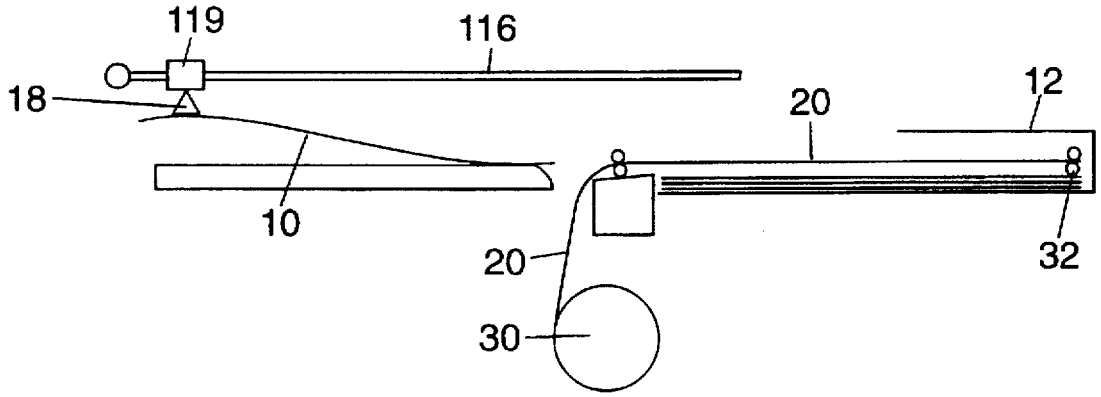
Figure 6:
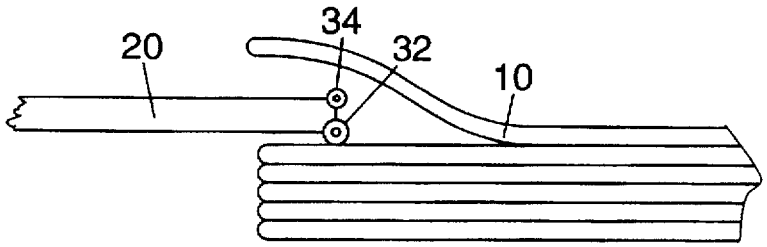
FIG. 6 is a close-up view of possible configuration of the leading edge of a separating slats member according to the present invention.
Figure 7:
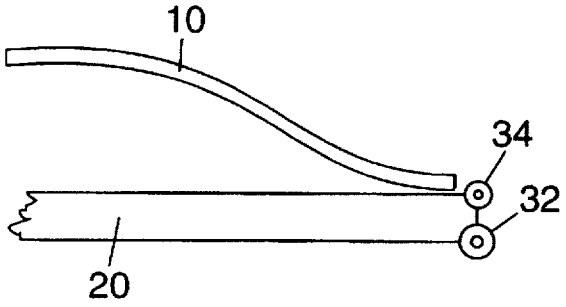
FIG. 7 shows one possible position of the leading edge of the separating slats member of FIG. 6 relative to the plate when the slats member is fully extended.

At this point, slidable unit 119, on which suction cups 18 are mounted, is moved in some suitable fashion to the left, dragging with them the top plate over the top of interposing member 20 (FIG. 5). When the top plate arrives at the desired position, suction cups 18 release the plate, as by releasing the vacuum which previously held the plate. This completes the moving of a plate to the desired location.

Prior to moving the next plate to the desired location, the following activities take place, either sequentially, or, preferably, concomitantly. Suction cups 18 are moved to the right so that they are in position to grab the next plate (FIG. 2) and interposing member 20 is rolled up, as through counterclockwise rotation of roller 30 so as to bring interposing member to the position shown in FIG. 2.

Preferably, plate interposing member 20 includes means for avoiding damage to the sensitive upper surface of the plate found directly below the plate being handled. In one embodiment, illustrated in FIGS. 4–7 and 9, the means for avoiding damage includes one or more wheels 32, or similar mechanisms, which are positioned at the bottom portion of interposing member 20 so that wheels 32 are the only portion of interposing member 20 which come in contact with the top surface of the stack of plates which directly underlie the plate being handled. The presence of upper wheel 34 prevents the scratching of the lower side of the plate being handled by allowing the plate being handled to readily roll over upper wheel 34 as interposing member 20 moves underneath, and lifts, the plate being handled.

Preferably, interposing member 20 includes an upper wheel 34, or comparable mechanism, at or near its forward end, for facilitating the lifting of the top plate without damaging it.

In an alternative embodiment according to the present invention, the movement of the upper plate can be effected not by the movement of slidable unit 119 as described above, but, rather, through the movement of interposing member 20, with upper wheel 34, or a similar mechanism, serving to push the top plate to the left as interposing member 20 rolls up and moves to the left.

Figure 8:
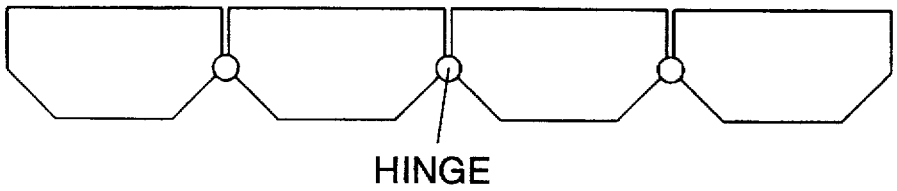
FIG. 8 is a close-up view of one possible configuration of a separating slats member according to the present invention.
Figure 9:
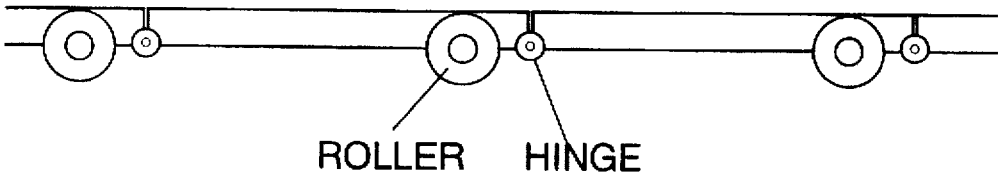
FIG. 9 is a close-up view of another possible configuration of a separating slats member according to the present invention.

In another alternative embodiment according to the present invention shown in partial view in FIG. 8, interposing member 20 includes means for preventing plate interposing member 20 from bending so as to contact the plate lying below the plate being handled. An example is shown in FIG. 8. Here, interposing member 20 is made up of a plurality of slats which are shaped so that they are able to bend to form a convex shape but not a concave shape, i.e., so that it is not possible for a central portion of interposing member 20 to bend downward so as to contact and possible scratch or otherwise damage the top surface of the underlying plate. Using such interposing member 20 calls for the use of but a single wheel 32 mounted at or near the anterior end of interposing member 20, thereby obviating the need for a plurality of wheels 32 (FIG. 9) and decreasing the size of roller 30 since interposing member 20 without a plurality of wheels 32 can be better packed on, or as part of, roller 30.

It should be noted that a system and method according to the present invention, in sharp contrast with conventional systems and methods, may easily be used with plates which are of various sizes, limited only by the dimensions of interposing member 20. Thus, for example, when it is desired to move a plate which is larger than can be accommodated by a single stroke of the suction cups, the plate can be effectively moved using a number of strokes. For example, a plate which is twice as long as the stroke of the suction cups can be moved by first grasping the near end of the plate and moving the plate half-way to its destination. The plate is then grasped at a point near its center and the plate is then moved the rest of the way to its destination.

Systems and methods according to the present invention can also be used with stacks of plates which include a paper separator sheet between adjacent plates. The handling procedure would be as described above except that after a plate has been removed and before the next plate is handled, the suction cups, or other suitable mechanism, will be used to remove the paper separator sheet. In this case, the suction cups will grasp the paper sheet and pull it off the stack of plates direct without using the interposing member. In addition, it may be possible to dispense with the use of the interposing member in the removal of the plates since the dragging of a plate directly across the paper separator sheet would presumably protect the top surface of the underlying plate from damage, rendering the use of the interposing member unnecessary.

While the invention has been described with respect to a limited number of embodiments, it will be appreciated that many variations, modifications and other applications of the invention may be made.

What is claimed is:

1. A plate feeding system for grasping and moving a plate from a stack of plates, comprising:

(a) an arm mechanism, said arm mechanism including a plate grasping member for grasping the plate;

(b) a flexible plate interposing member for interposing between the plate and an adjacent plate; and (c) a mechanism for rolling and unrolling said plate interposing member, said plate interposing member being unrolled when said plate interposing member is interposed between the plate and said adjacent plate.

2. A system as in claim 1, wherein said plate grasping member is an array of suction cups.

3. A system as in claim 1, wherein said plate interposing member includes a plurality of interconnected slats.

4. A system as in claim 3, wherein said plate interposing member includes means for avoiding damage to said adjacent plate.

5. A system as in claim 4, wherein said means for avoiding damage to said adjacent plate includes means for preventing said plate interposing member from bending so as to contact said adjacent plate.

6. A system as in claim 1, wherein said plate interposing member includes means for avoiding damage to said adjacent plate.

7. A system as in claim 6, wherein said means for avoiding damage to said adjacent plate includes at least one roller for rolling over said adjacent plate.

8. A system as in claim 1, wherein said plate interposing member includes a roller substantially at its anterior end for contacting the plate.

* * * * *